US010987676B2

(12) United States Patent
Sanguesa et al.

(10) Patent No.: US 10,987,676 B2
(45) Date of Patent: Apr. 27, 2021

(54) HIGH EFFICIENCY CONICAL MILLS

(71) Applicant: QUADRO ENGINEERING CORP., Waterloo (CA)

(72) Inventors: Wilf Sanguesa, Waterloo (CA); Barry Watson, Waterloo (CA); Jeff Verberne, Guelph (CA); Sean Watson, Kitchener (CA)

(73) Assignee: Quadro Engineering Corp., Waterloo (CA)

( * ) Notice: Subject to any disclaimer, the term of this patent is extended or adjusted under 35 U.S.C. 154(b) by 213 days.

(21) Appl. No.: 15/753,818

(22) PCT Filed: Jul. 12, 2016

(86) PCT No.: PCT/IB2016/001130
§ 371 (c)(1),
(2) Date: Feb. 20, 2018

(87) PCT Pub. No.: WO2017/033050
PCT Pub. Date: Mar. 2, 2017

(65) Prior Publication Data
US 2019/0009278 A1 Jan. 10, 2019

Related U.S. Application Data

(60) Provisional application No. 62/208,281, filed on Aug. 21, 2015.

(51) Int. Cl.
*B02C 18/06* (2006.01)
*B02C 23/16* (2006.01)

(52) U.S. Cl.
CPC ..... *B02C 18/062* (2013.01); *B02C 23/16* (2013.01); *B02C 2023/165* (2013.01)

(58) Field of Classification Search
CPC . B02C 18/062; B02C 23/16; B02C 2023/165; B02C 13/18; B03B 5/56
(Continued)

(56) References Cited

U.S. PATENT DOCUMENTS 4,759,507 A 7/1988 Lynch et al.
5,282,579 A * 2/1994 Poser ..... B02C 13/18 241/101.3
(Continued)

FOREIGN PATENT DOCUMENTS

CN 2002981523 U 6/2013
GB 609757 A * 10/1948 ..... A47J 19/005
(Continued)

OTHER PUBLICATIONS

Laurel Leaf Farm, "vintage kitchen food mill / juicer, strainer sieve cone and wood masher", Mar. 26, 2015, Laurel Leaf Farm, https://web.archive.org/web/20150326025622/https://laurelleaffarm.com/item-pages/kitchen&table/vintage-food-mill.htm (Year: 2015).*
(Continued)

*Primary Examiner* — Adam J Eiseman
*Assistant Examiner* — Dylan Schommer
(74) *Attorney, Agent, or Firm* — Tucker Ellis LLP; Heather M. Barnes; Michael G. Craig

(57) ABSTRACT

Screens for conical mills and an improved gearbox and housing for such conical mills are shown and described. The screens are frusto-conically-shaped and include a tapered sidewall with a plurality of openings in the sidewall that may be of uniform size. Each opening is separated from adjacent openings by spacing distances which are shorter at the top of the tapered sidewall and longer at the bottom of the tapered sidewall to thereby reduce the residence time of the powder being milled at the top of the tapered sidewall and to
(Continued)

increase the residence time of the powder being milled at the bottom of the tapered sidewall.

6 Claims, 12 Drawing Sheets

(58) Field of Classification Search
USPC ..... 241/38–74
See application file for complete search history.

(56) References Cited

U.S. PATENT DOCUMENTS

| | | | | |
|---|---|---|---|---|
| 5,330,113 | A | 7/1994 | Poser et al. | |
| 5,405,094 | A * | 4/1995 | Poser | B02C 18/062 241/160 |
| 5,607,062 | A | 3/1997 | Poser et al. | |
| 5,765,767 | A * | 6/1998 | Iwata | B07B 1/06 241/286 |
| 6,367,723 | B1 * | 4/2002 | Kircher | B02C 18/062 241/69 |
| 8,900,415 | B2 | 12/2014 | Rolland et al. | |

FOREIGN PATENT DOCUMENTS

| | | | |
|---|---|---|---|
| JP | S57-500093 | A | 1/1982 |
| JP | H07-846 | A | 1/1995 |
| JP | H08-89831 | A | 4/1996 |
| JP | H09-108585 | A | 4/1997 |
| JP | 2002-192017 | A | 7/2002 |
| KR | 10-00934435 | B1 | 12/2009 |
| WO | 81/02398 | A1 | 9/1981 |
| WO | 2004050249 | A1 | 6/2004 |

OTHER PUBLICATIONS

Jurgen Vercruysse, "Innovation in Pharmaceutical Manufacturing of Solid Dosage Forms Via Continuous Wet Granulation", Jul. 30, 2014, Ghent University (Year: 2014).*

Glatt, "Glatt Rotor Sieve GSE", May 23, 2014, Youtube, https://www.youtube.com/watch?v=B1gAq4a3sDI (Year: 2014).*

PCT International Search Report, PCT/IB2016/001130, dated Oct. 21, 2016, 2 pages.

The Written Opinion of the International Searching Authority, PCT/IB2016/001130, dated Oct. 21, 2016, 3 pages.

European Patent Office, European Search Report from International Application No. EP16838617.5, dated Mar. 26, 2019, 30 pages.

Japanese Office Action for related Application No. 2018-528103, dated Jan. 29, 2020, 5 pages.

Chinese Office Action for related Application No. 2020011001045020, dated Jan. 15, 2020, 3 pages.

India Examination Report for related Application No. 201817006350, dated Mar. 3, 2020, 7 pages.

* cited by examiner

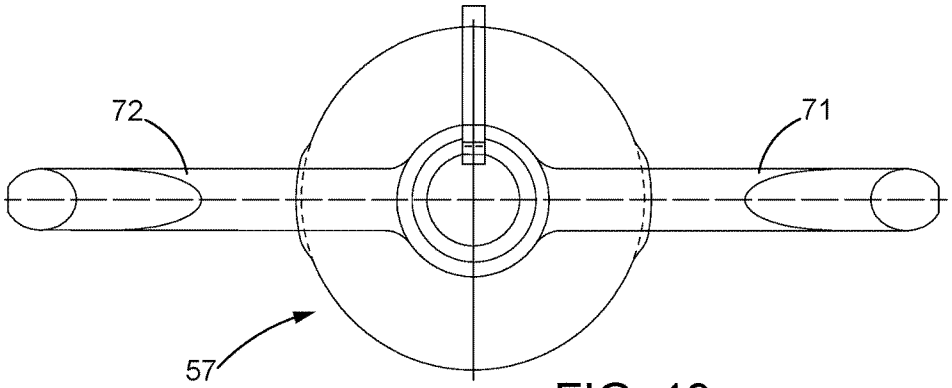
FIG. 19
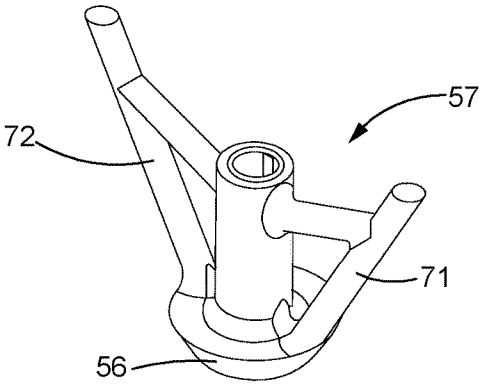
FIG. 17
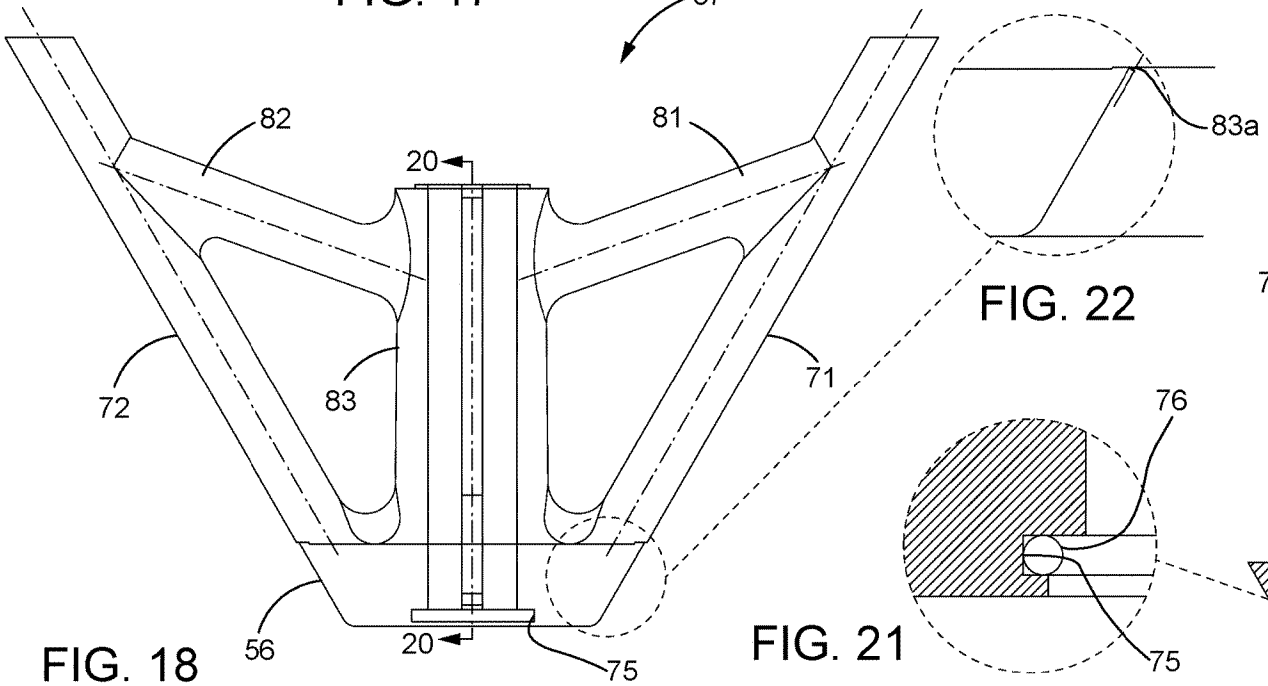
FIG. 22
FIG. 18
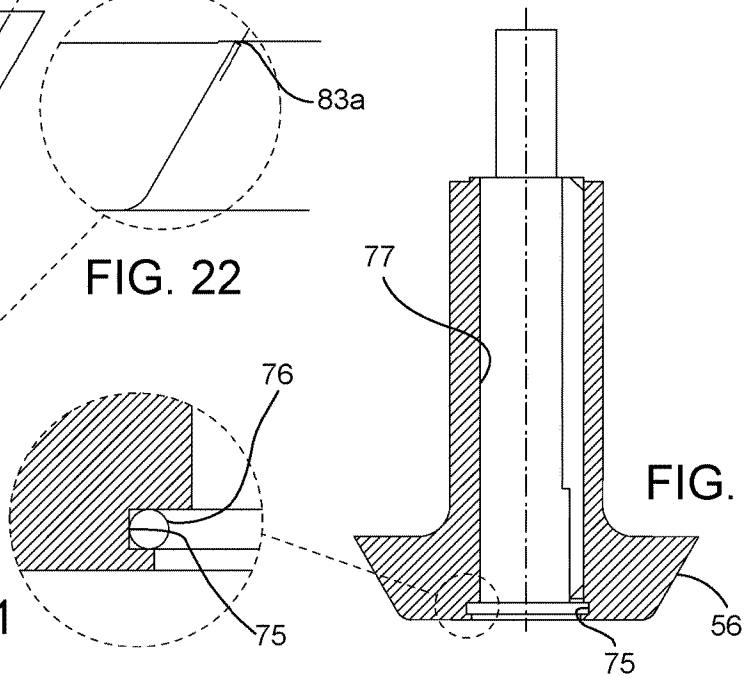
FIG. 20
FIG. 21

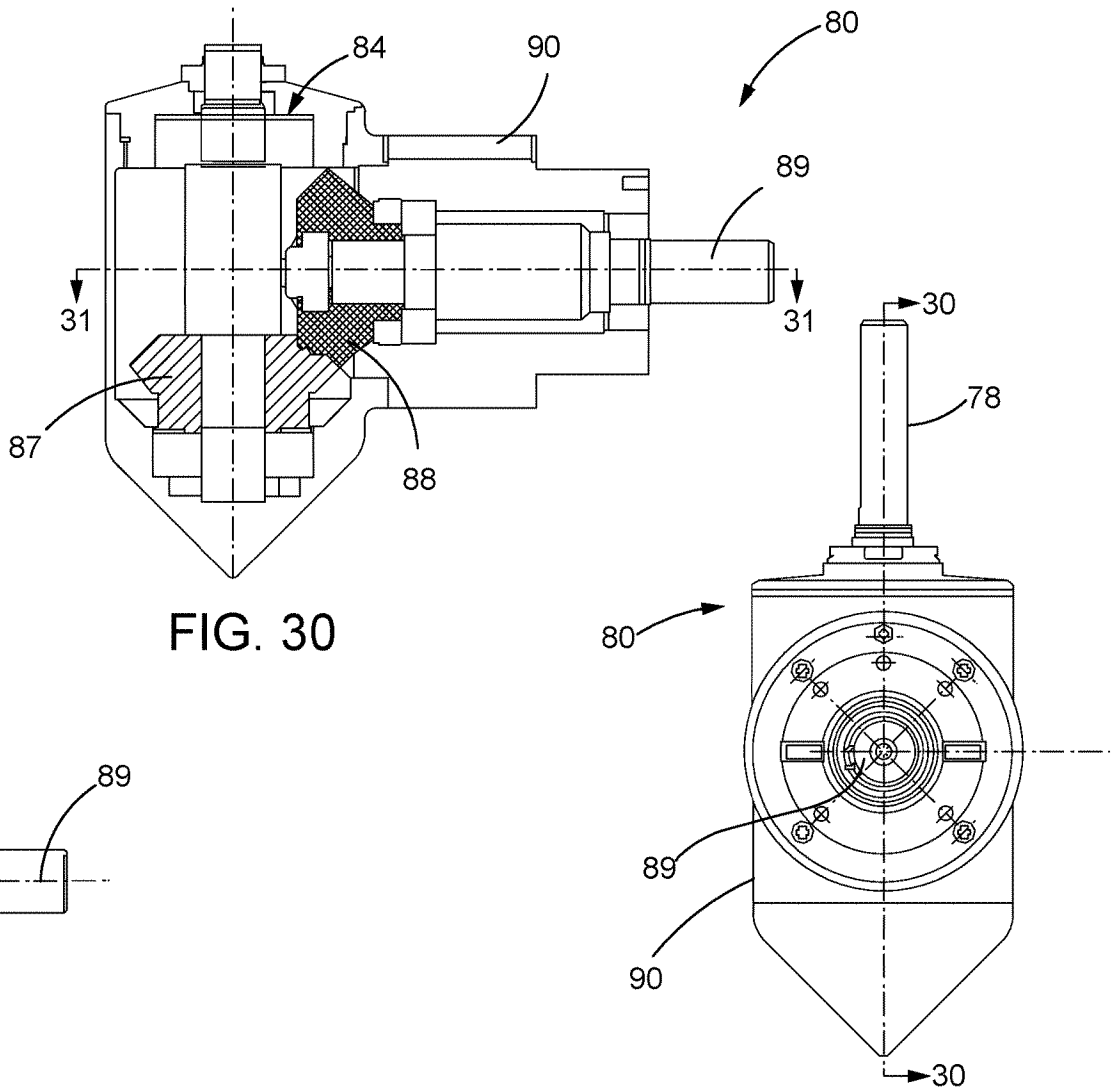
FIG. 30
FIG. 32
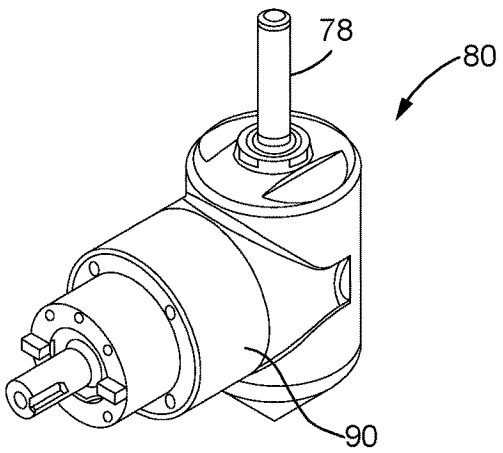
FIG. 29
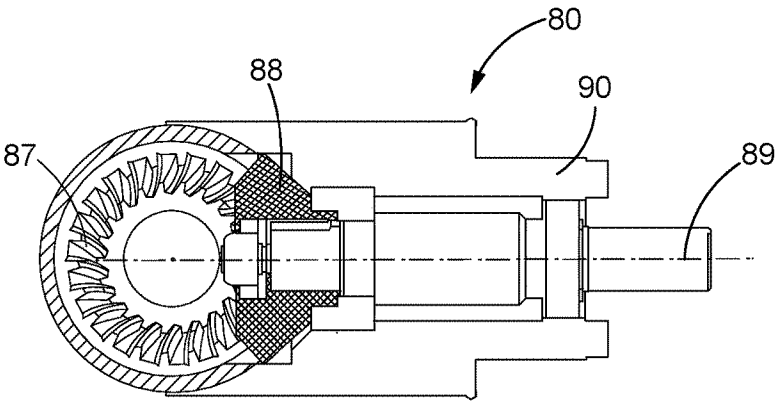
FIG. 31

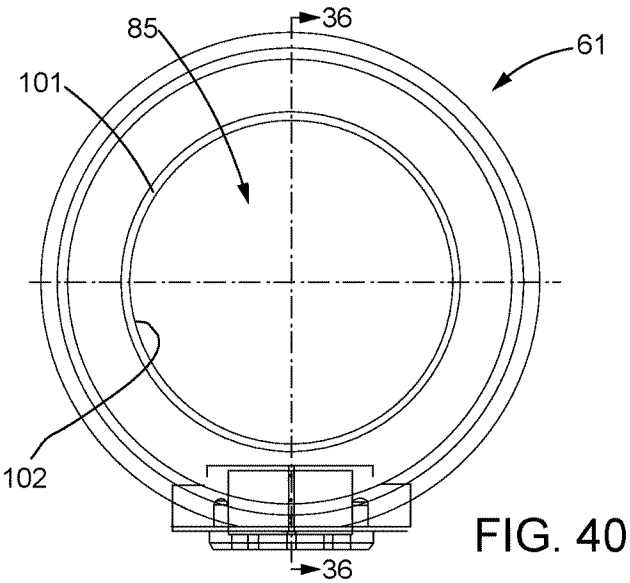
FIG. 40
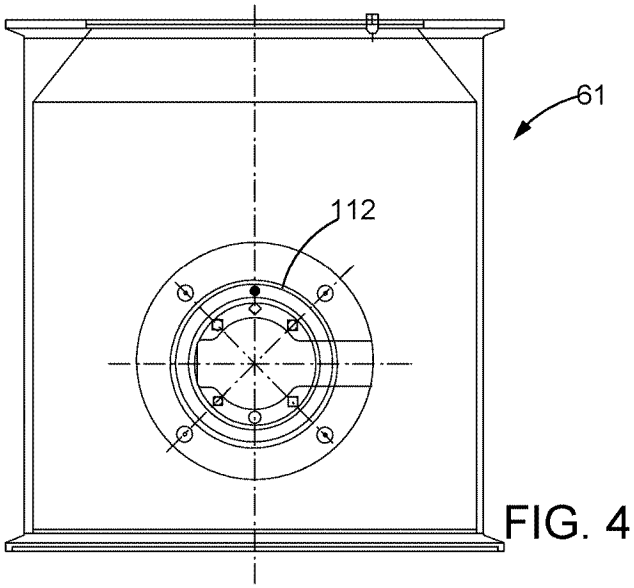
FIG. 41
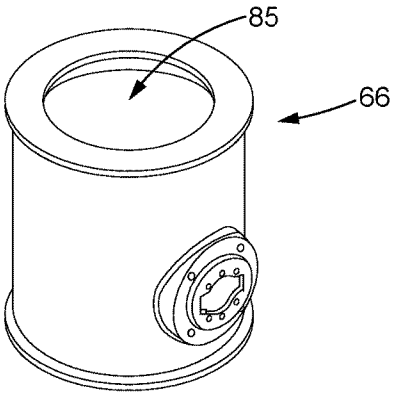
FIG. 35
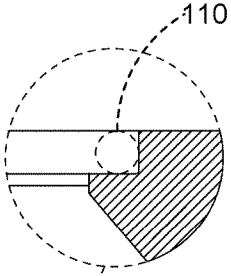
FIG. 37
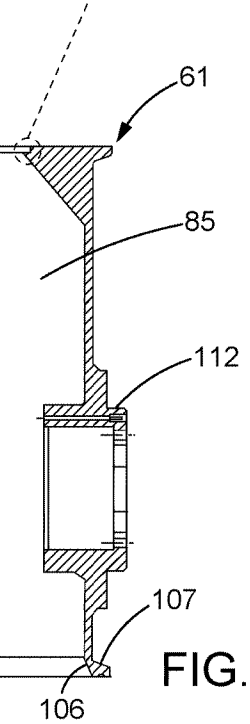
FIG. 36
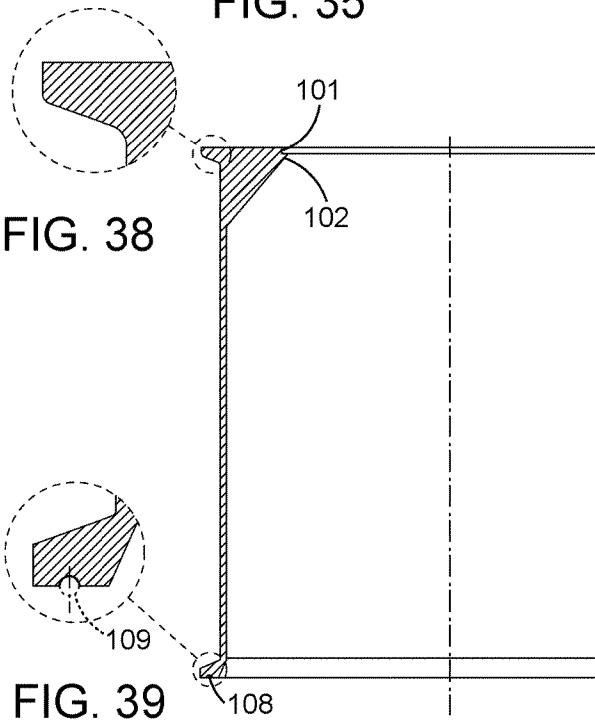
FIG. 38
FIG. 39

HIGH EFFICIENCY CONICAL MILLS

RELATED APPLICATION DATA

This application is a national phase application of and claims priority to International Application No. PCT/162016/001130 filed Jul. 12, 2016, which claims priority to U.S. Provisional Patent Application No. 62/208,281 filed Aug. 21, 2015, which are hereby all incorporated herein by reference.

BACKGROUND

Technical Field

This disclosure relates to conical mills used to reduce the particle size of granular materials. More specifically, this disclosure relates to the conical screens used in such conical mills, which include a hole pattern that varies from the top to the bottom of the sidewall for narrower particle size distributions, reduced heat generation and increased capacity. The disclosed conical mills may be cleaned without disassembly and the disclosed conical mills feature lubricant-free gearboxes, which reduce the risk of product contamination.

Description of the Related Art

Conical mills are widely used in the production of powders used in pharmaceuticals, food and cosmetics. Powders are typically manufactured as solid or granular materials before being size-reduced into the desired final powder particle size distribution or form. For example, the manufacture of pharmaceutical tablets requires milling (or size-reduction) of the granular material to a milled powder that can easily flow and be pressed into a tablet.

Conical mills of the prior art include an impeller or rotor disposed within a conical or frusto-conically-shaped classifying screen located between an input and an output, all of which is disposed within a milling chamber. See, e.g., U.S. Pat. Nos. 4,759,507, 5,282,579, 5,330,113 and 5,607,062, all commonly assigned to Quadro Engineering. These conical mills employ various screen and impeller combinations to reduce the particle size of the incoming granular material. The choice of the screen and impeller combination depends on the desired particle size distribution (PSD) and the type of granular product being processed. While the openings of each screen are of a uniform size and shape, various screens are available with openings of different sizes and shapes that help determine the PSD of the milled powder product.

Prior art screens used by various milling technologies have the same size openings (holes) and open area percentage throughout the entire surface of the screen, as they are made from blanks by punching, chemically etching or laser cutting the openings. For conical mills, these screens have about a 60-degree profile (larger diameter at the top, tapering down towards the bottom), with the impeller matching the profile of the screen. When the impeller rotates, the velocity of the impeller arms is higher near the wider top of the screen than at the narrower bottom of the screen. As a result, the energy imparted to the solid product or powder is not consistent from the top to the bottom of the screen. Due to the varying speeds of the impeller arms, uneven milling forces are applied to the solid product, resulting in a wider PSD range because powder near the top of the sidewall experience more energy in the form of faster arm speeds and therefore is more size-reduced than the powder near the bottom of the sidewall.

From a mechanical process perspective (assuming the formulation is stable), the strength and durability of a tablet pressed from milled powder is highly dependent on the PSD, the bulk density and the flowability of the milled powder. Excessive amounts of particles falling above or below the target PSD can cause tableting defects and are sometimes removed or discarded, resulting in waste. Further, the disposal of at least some pharmaceutical products requires special handling due to environmental regulations that increase the cost of the product or the loss associated with the production of particles that fall outside of the target PSD. Hence, conical mills that can provide narrow PSDs of powders with less waste are in demand.

Because pharmaceutical, food and cosmetic industries have very strict sanitary standards for operation and production, conical mills must be capable of full sanitization. Further, because the production of powders may create an inhalation hazard, and a particularly acute hazard when it comes to some pharmaceutical compounds, the milling chamber must provide adequate containment of the milled powder and any dust created by the milling process. Because of the potentially hazardous nature of some powders, the pharmaceutical industry is trending toward equipment that does not require manual cleaning, but rather equipment that can be cleaned automatically without operator exposure to the milled powder or dust, and without the need to move the equipment, which is also characterized as "clean-in-place" or CIP designs. Therefore, any improved conical mill should also be a CIP design.

Finally, conical mills can generate substantial noise during operation, which requires operators to wear ear protection. With a manufacturer operating several or dozens of conical mills in one area of facility, noise generation from conical mills can be problematic. Hence, improved conical mills that generate less noise are in demand.

SUMMARY OF THE DISCLOSURE

In order to meet the demands of the pharmaceutical, food, chemical and cosmetics industries, this application discloses improved conical mills with one or more improvements in the form of redesigned screens, impellers, housings and/or gearboxes. The disclosed screens and/or the disclosed screens in combination with the disclosed impellers provide narrower PSDs, reduced heat generation and improved throughput. The disclosed housings and gearboxes of the disclosed conical mills eliminate or substantially reduce sound generation, the possibility of product contamination from the gearbox and the disclosed conical mills may be cleaned in place (CIP design).

Disclosed herein are new "progressive open area percentage" screens that counter the uneven impeller forces from top to bottom, by varying the percentage of open area of the screens from top to bottom (or by varying the spacing distances between the openings). By changing the open area percentage, the slower impeller speeds near the bottom of the sidewall are compensated for with a lower open area percentage and longer spacings between openings, thereby giving the powder at the bottom of the screen exposure to more impeller rotations (i.e., longer residence times) before it passes through the openings. Further, the top or upper portion of the screen has more openings or a greater open area percentage because the higher rotational speed of the impeller at the top of the screen requires less exposure of the powder to the impeller and, hence, the need for a higher open area percentage and shorter spacings between openings. As a result, milling forces seen by the powders inside the milling chamber are evenly distributed across the entire height or length of the screen, resulting in more particles having similar sizes once milled and therefore narrower PSDs. The redesigned screen opening (hole) patterns increase the open area percentage near the top of the sidewall by up to 50% over traditional conical screens, thereby reducing the residence time inside the milling chamber, reducing heat generation and improving capacity.

In addition, to address the clean-in-place (CIP) requirement, the disclosed conical mills incorporate an impeller with a captured O-ring configuration and redesigned impeller cross arms ensuring full cleaning coverage of all powder-contact surfaces without the need to open the equipment to clean manually. Furthermore, complete containment of powders and cleaning solution is achieved inside the milling chamber via two O-rings, located above and below the screen's contact points with the feed chute and the housing. This ensures that powders during milling are only present in the internal contact surface areas and cleaning solutions cannot escape or be trapped in crevices after a cleaning cycle.

The disclosed conical mill employs non-metallic gears inside the gearbox, eliminating the need to use grease to lubricate. The gearbox is isolated from the product contact zone with the use of seals. These seals make positive contact with the rotating shaft to ensure that no product can penetrate the gearbox and no grease/lubricant can escape the gearbox and contaminate the powders being milled. To avoid the use of grease or lubricant in the gearbox altogether, the gearbox may employ non-metallic composite gears.

The gearbox disclosed herein may house high strength composite material gears, which can be operated reliably and consistently without the need to add any lubrication or grease. Therefore, even if a shaft seal is inadvertently compromised, the product will not be contaminated from the gearbox. In the pharmaceutical and food industries where a large percentage of these machines are sold, eliminating this potential source of contamination is deemed critical. In contrast, prior art gearboxes currently used for size-reduction apparatuses employ steel, stainless steel or bronzed gears—with FDA approved lubricant. Nevertheless, should this lubricant contaminate a batch of product, the batch will need to be discarded In one aspect, a screen for a mill includes a tapered sidewall having a wider top and a narrower bottom. The sidewall includes a plurality of openings that may be of a uniform size. Each opening is separated from adjacent openings by spacing distances. The spacing distances at the top of the sidewall being shorter than the spacing distances at the bottom of the sidewall. As a result, the open area percentage at the top of the sidewall is greater than the open area percentage at the bottom of the sidewall.

In any one or more of the embodiments described above, a mill includes a housing that accommodates a frusto-conically shaped screen that includes a tapered sidewall having a wider top and a narrower bottom. The sidewall includes a plurality of openings of a uniform size. Each opening is separated from adjacent openings by a spacing distance. The spacing distances at the top of the sidewall being shorter than the spacing distances at the bottom of the sidewall (and, consequently, the open area percentage at the top of the sidewall is greater than the open area percentage at the bottom of the sidewall). The sidewall accommodates an impeller mounted coaxially within the sidewall of the screen. The impeller includes a lower base disposed at the bottom of the sidewall of the screen and the lower base may be connected to an output shaft that extends through the bottom of the sidewall of the screen. The base connects to at least one milling member that extends from the top to the bottom and along the sidewall. The output shaft of the impeller connects to an output gear. The output gear meshes with an input gear. The input gear may connect to an input shaft, which may connect to a motor. In an embodiment, non-metallic composite materials may be used to fabricate the input gears.

In yet another aspect, a method for size-reducing a flowable solid material may include providing a mill that includes a housing that accommodates a screen between a top and a bottom of the housing. The screen includes a frusto-conically shaped sidewall having a wider top and a narrower bottom. The sidewall screen includes a plurality of openings of a uniform size. However, each opening is separated from adjacent openings by spacing distances. The spacing distances between openings at the top of the sidewall of the screen are shorter than the spacing distances between the openings at the bottom of the sidewall of the screen (and, consequently, the open are percentage at the top of the screen exceeds the open area percentage at the bottom of the screen). Further, the sidewall accommodates an impeller mounted coaxially within the sidewall. The impeller comprises at least one milling member that extends parallel to the sidewall from the top to the bottom of the sidewall. The method further includes rotating the impeller, delivering flowable solid material through the top of the housing and through the top of the sidewall of the screen, pressing the flowable solid material through the openings in the sidewall of the screen with the rotating impeller to produce size-reduced material, and collecting the size-reduced material.

In any one or more of the embodiments described above, an open area percentage provided by the openings in the sidewall of the screen is greater at the top of the sidewall of the screen than at the bottom of the sidewall of the screen.

In any one or more of the embodiments described above, the sidewall of the screen is frusto-conically shaped.

In any one or more of the embodiments described above, the openings in the sidewall of the screen have a shape selected from the group consisting of round, square and rectangular.

In any one or more of the embodiments described above, the sidewall, at each opening, includes an inwardly extending dimple or rasp.

In any one or more of the embodiments described above, the sidewall of the screen includes a total surface area interrupted by the openings. The sidewall also includes an upper section, an upper middle section, a lower middle section and a lower section. The openings in the upper section provide an open area percentage ranging from about 30% to about 50% of the total surface area of the sidewall in the upper section, the openings in the upper middle section provide an open area percentage ranging from about 25% to about 45% of the total surface area of the sidewall in the upper middle section, the openings in the lower middle section provide an open area percentage ranging from about 20% to about 40% of the total surface area of the sidewall in the lower middle section and the openings in the lower section provide an open area percentage ranging from about 15% to about 35% of the total surface area of the sidewall in the lower section.

In any one or more of the embodiments described above, the sidewall of the screen includes a total surface area interrupted by the openings that accumulatively provide an open area percentage. The open area percentage may range from about 30% to about 50% at the top of the sidewall while the open area percentage may range from about 15% to about 35% at the bottom of the sidewall and the openings disposed between the top and bottom of the sidewall may provide an open area percentage ranging from less than about 40% to greater than about 25%.

In any one or more of the embodiments described above, at least part of the output shaft, the output shaft and at least part of the input shaft are disposed within a gearbox. The gearbox is sealably connected to the housing. Further, the gearbox contains no lubricant.

In any one or more of the embodiments described above, the impeller includes a lower base disposed at the bottom of the sidewall of the screen, which connects to an output shaft that extends through the bottom of the sidewall of the screen. The base connects to at least one milling member that extends from the top to the bottom of the sidewall of the screen. The output shaft connects to an output gear. The output gear meshes with an input gear. The input gear connects to an input shaft and the input shaft connects to a motor. In such an embodiment, the input gears are fabricated from non-metallic composite materials. In a further refinement of this concept, the output shaft and at least part of the input shaft are disposed within a gearbox, which sealably connects to the housing of the conical mill. Further, the gearbox includes no lubricant because the use of non-metallic composite materials for the input gears eliminates the need for lubricant.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein:

FIG. 17 is a perspective view of an impeller for use in the conical mill apparatus illustrated in FIGS. 23-28 and with the screens illustrated in FIGS. 1-16.

FIG. 18 is a front plan view of the impeller shown in FIG. 17.

FIG. 19 is a top plan view of the impeller shown in FIGS. 17-18.

FIG. 20 is a sectional view taken substantially along line 20-20 of FIG. 18.

FIG. 21 is a partial enlarged and sectional view of the impeller as shown in FIG. 20, particularly illustrating the location of a captured O-ring.

FIG. 22 is a partial enlarged view of the impeller as shown in FIG. 18, particularly illustrating a junction of the lower end of the impeller and a milling member or arm.

FIG. 29 is a perspective view of the gearbox assembly of the conical mill apparatus shown in FIGS. 23-28.

FIG. 30 is a partial sectional view taken substantially along line 30-30 of FIG. 32.

FIG. 31 is a partial sectional view taken substantially along line 31-31 of FIG. 30.

FIG. 32 is a front view of the gearbox assembly shown in FIGS. 29-31.

FIG. 35 is a perspective view of the housing that forms part of the milling chamber.

FIG. 36 is a sectional view taken substantially along line 36-36 of FIG. 40.

FIG. 37 is an enlarged partial and sectional view of the housing as shown in FIG. 36.

FIG. 38 is an enlarged and partial sectional view of the housing as shown in FIG. 36.

FIG. 39 is another enlarged and partial sectional view of the housing as shown in FIG. 36.

FIG. 40 is a top view of the housing as shown in FIGS. 35-36 and 40.

FIG. 41 is a front view of the housing as shown in FIGS. 35-36.

The drawings are not necessarily to scale and may illustrate the disclosed embodiments diagrammatically and in partial views. In certain instances, the drawings omit details which are not necessary for an understanding of the disclosed methods and apparatuses or which render other details difficult to perceive. Further, this disclosure is not limited to the particular embodiments illustrated herein.

DETAILED DESCRIPTION OF THE PRESENTLY PREFERRED EMBODIMENTS

Figure 1:
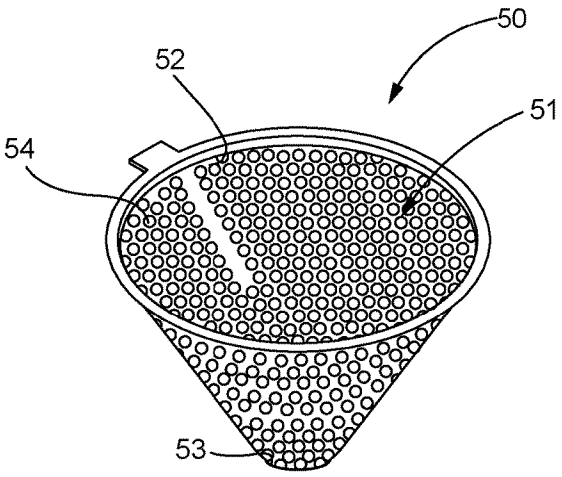
FIG. 1 is a perspective view of a disclosed screen for use in the disclosed conical mill illustrated in FIGS. 23-28.
Figure 2:
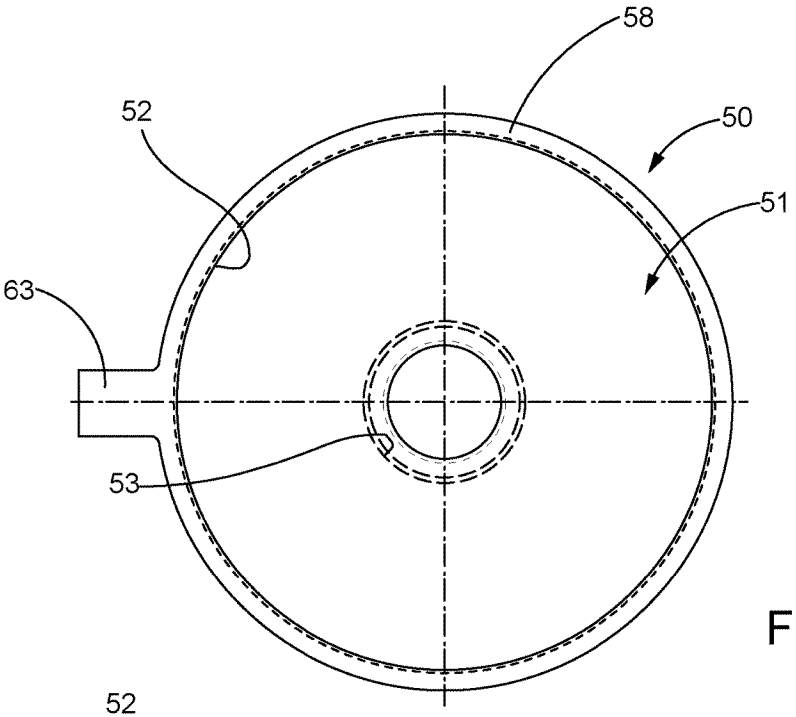
FIG. 2 is a top plan view of the screen shown in FIG. 1.
Figure 3:
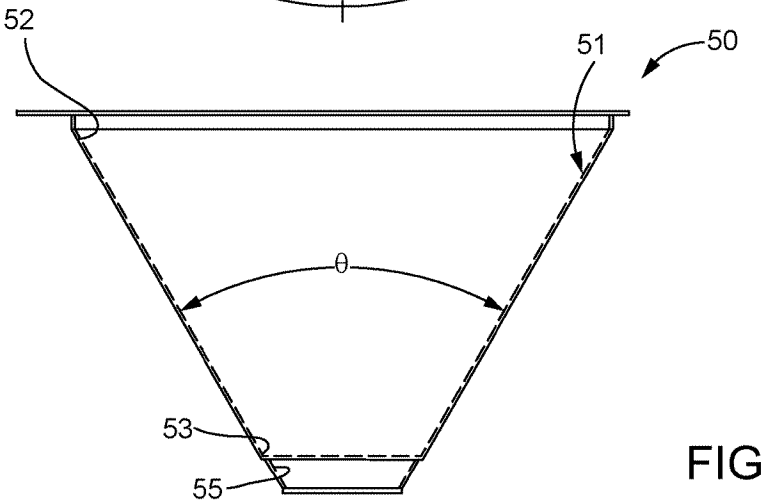
FIG. 3 is front plan view of the screen illustrated in FIGS. 1-2.
Figures 23, 24, 25, 26, 27, 28:
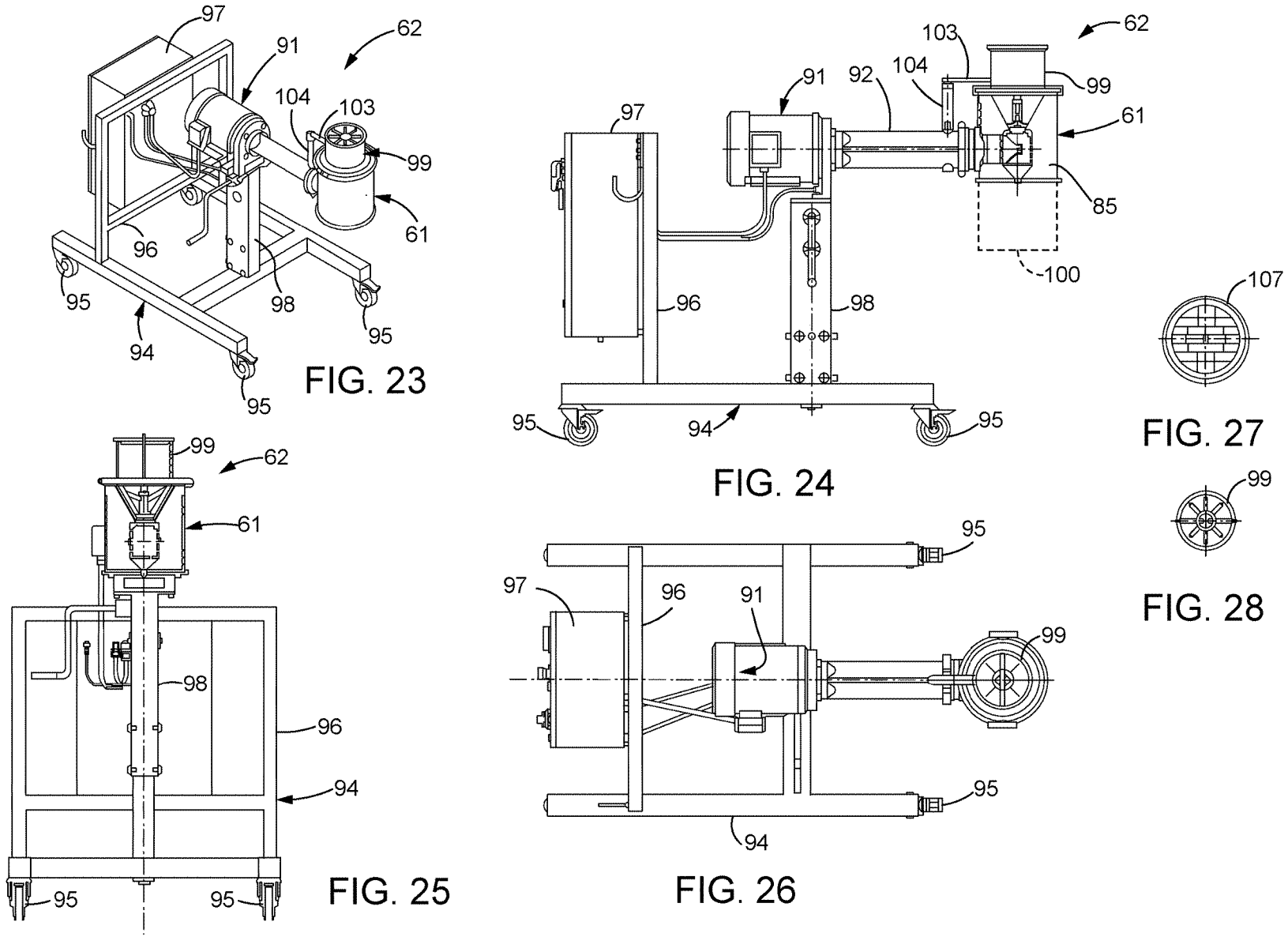
FIG. 23 is a perspective view of a disclosed conical mill apparatus.
FIG. 24 is a side plan view of the apparatus shown in FIG. 23.
FIG. 25 is a front plan view of the apparatus shown in FIGS. 23-24.
FIG. 26 is a top plan view of the apparatus shown in FIGS. 23-25.
FIG. 27 is a partial bottom view of the milling chamber of the apparatus shown in FIGS. 23-26.
FIG. 28 is a partial top view of the milling chamber of the apparatus shown in FIGS. 23-26.
Figure 33:
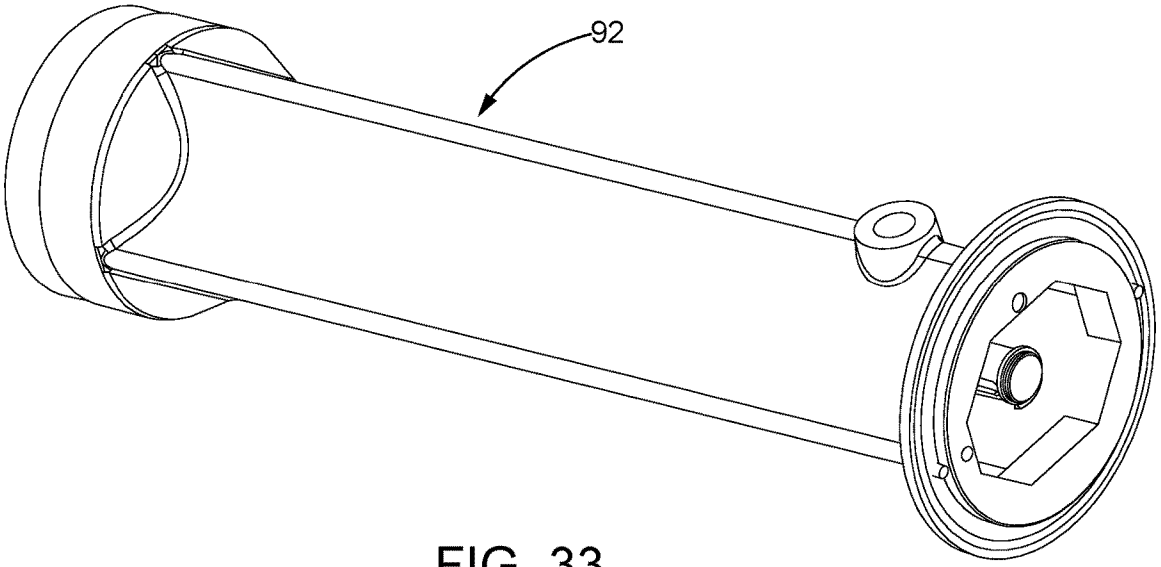
FIG. 33 is a perspective view of a spindle used to connect the gearbox assembly shown in FIGS. 29-32 to the motor of the conical mill apparatus shown in FIGS. 23-24 and 26.

FIGS. 1-3 generally illustrate the configuration of a frusto-conical screen 50 for use in the conical mill 62 illustrated in FIGS. 23-28. The screen 50 includes a tapered sidewall 51 that includes a wider top 52 and a narrower bottom 53. The tapered sidewall 51 includes a plurality of openings or openings 54 that are of a uniform size. Typically, the angle θ between diametrically opposed portions of the tapered sidewall 51 is about 60°, but the exact geometry of the screen 50 may vary as will be apparent to those skilled in the art. The bottom 53 connects to another frusto-conical bottom section 55 for receiving the lower end 56 of the impeller 57 illustrated in detail in FIGS. 17-20. The screen 50 also includes an outer flange 58 for supporting the screen 50 within the housing 61 of the conical milling 62 as illustrated in FIGS. 24-25. The screen 50 may also include a tab 63 for ease of handling.

Figures 4, 5, 6, 7, 8:
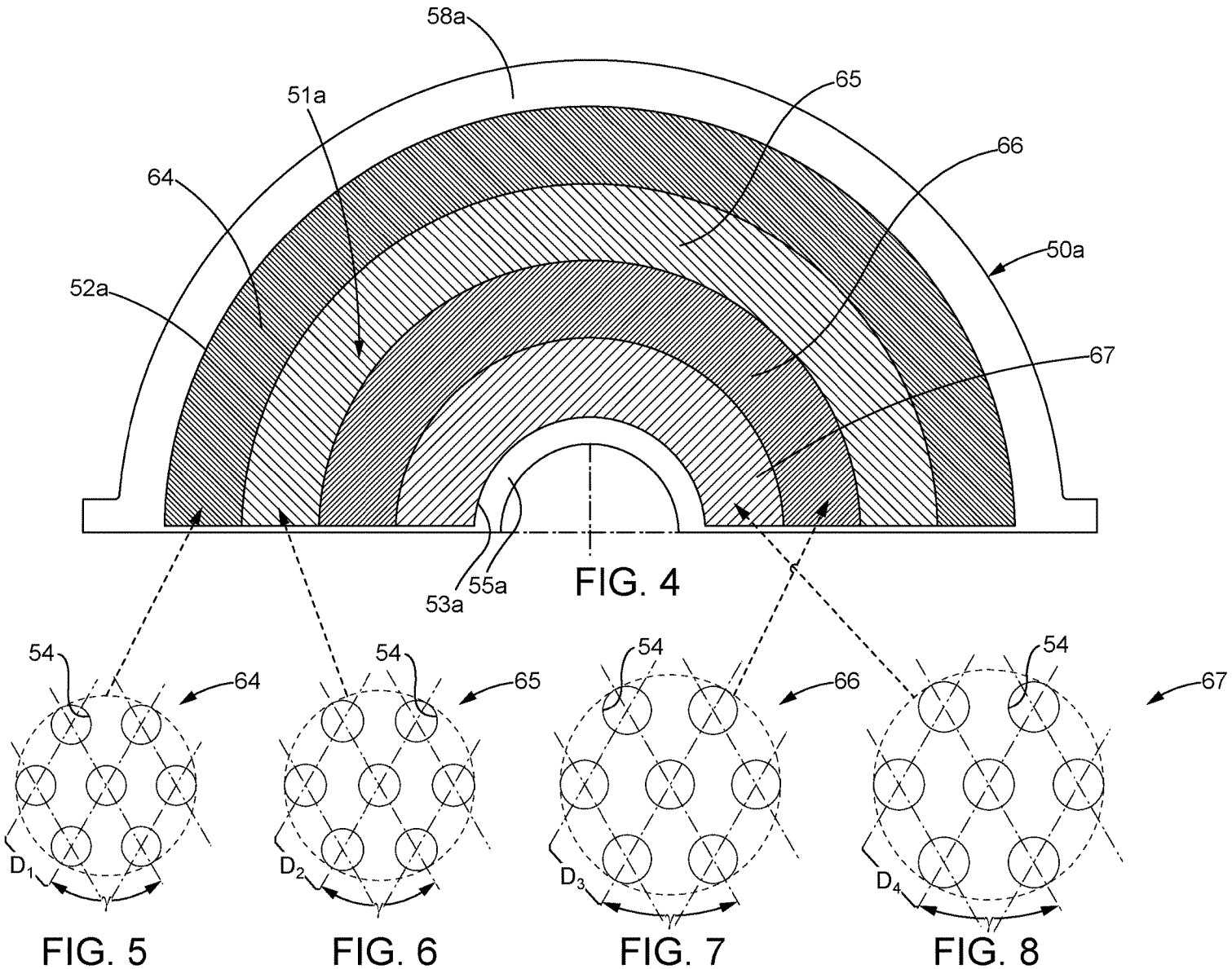
FIG. 4 is a partial top view of a disclosed frusto-conical screen for use in the conical mill apparatus illustrated in FIGS. 23-28, and particularly illustrating four distinct sections with different hole patterns, each section being illustrated in greater detail in FIGS. 5-8.
FIG. 5 is a partial and enlarged partial plan view of the hole pattern of the upper section of the screen illustrated in FIG. 4.
FIG. 6 is a partial and enlarged view of the hole pattern of the upper middle section of the screen illustrated in FIG. 4.
FIG. 7 is a partial and enlarged view of the hole pattern of the lower middle section of the screen illustrated in FIG. 4.
FIG. 8 is a partial and enlarged view of the hole pattern of the lower section of the screen illustrated in FIG. 4.

FIG. 4 illustrates a partial top view of another disclosed screen 50*a* that also includes a tapered sidewall 51*a* that includes a top 52*a* and a bottom 53*a*. The screen 50*a* also includes a bottom section 55*a* for receiving the lower end 56 of the impeller 57 and a flange 58*a* for supporting the screen 50*a* at the groove 101 at the top of the housing 61 of the conical mill 62 (FIGS. 24-25 and 36). The top view provided by FIG. 4 also reveals that the screen 50*a* includes four distinct sections including an upper section 64 disposed inside the top 52*a* of the tapered sidewall 51*a*, an upper middle section 65, a lower middle section 66 and a lower section 67. The lower section 67 is disposed between the bottom 53*a* of the tapered sidewall 51*a* and the lower middle section 66, which is disposed between the upper middle section 65 and lower section 67, which is disposed between the upper section 64 and the lower middle section 66 as shown in FIG. 4. The four sections 64-67 may have different hole patterns, different spacing distances between openings 54 and different open area percentages as illustrated in greater detail in FIGS. 6-8.

Each section includes a plurality of openings 54 that may be of a uniform size. However, the spacing distances between the openings 54 vary from the upper section 64 to the lower section 67. The upper section 64 engages to the upper portions of the milling members 71, 72 of the impeller 57, which travel at a faster rotational velocity than lower portions of the milling members 71, 72. Therefore, the upper sections 64 of the screen 50*a* are exposed to a greater amount of energy from the impeller 57 while the lower section 67 of the screen 50*a* is exposed to a lower amount of energy from the rotating impeller 57. Generally, the energy delivered by the rotating impeller 57 decreases along the tapered sidewall 51*a* from the upper section 64 to the bottom section 67. As a result, more openings 54 are required for the upper section 64 in order to reduce the residence time because the flowable material that is being milled in the upper section 64 will be reduced to within the target PSD before the flowable material being milled in the upper middle section 65, lower middle section 66 or lower section 67. In contrast, because the lower section 67 is engaged by the lower portions of the milling members 71, 72 of the impeller 57, which are traveling at the lowest rotational velocity, the flowable material being milled at the lower section 67 is exposed to less energy, and therefore requires a higher residence time to achieve the target PSD. Thus, the lower section 67 has fewer openings 54, longer spacings between openings 54 and a lower open area percentage.

Accordingly, in FIG. 5, the spacing distance $D_1$ of the upper section 64 is shorter than the spacing distance $D_2$ of the upper middle section 65 illustrated in FIG. 6, which is shorter than the spacing distance $D_3$ of the lower middle section 66 as illustrated in FIG. 7 and which is shorter than the spacing distance $D_4$ of the lower section 67 as illustrated in FIG. 8. Thus, the upper section 64 has the highest open area percentage and the smallest spacing distance $D_1$ between openings 54 while the lower section 67 has the lowest open area percentage and the greatest spacing distance $D_4$ between adjacent openings 54.

In the embodiment shown, the angle γ between the openings 54 for the hole patterns illustrated in FIGS. 5-8 may be about 60° although the angle γ may vary as will be apparent to those skilled in the art.

The open area percentage for the four distinct sections 64, 65, 66, 67 of the screen 50*a* may range from about 30% to about 50% for the upper section 64, from about 25% to about 45% for the upper middle section 65, from about 20% to about 40% for the lower middle section 66 and from about 15% to about 35% for the lower section 67. However, the open area percentages as well as the spacing distances $D_1$-$D_4$ may vary greatly, as will be dependent on the material being milled, the desired PSD, operating conditions and other factors as will be apparent to those skilled in the art. In one non-limiting example, the open area percentages for the sections 64-67 may be 40%, 35%, 30% and 25% respectively.

Figure 9:
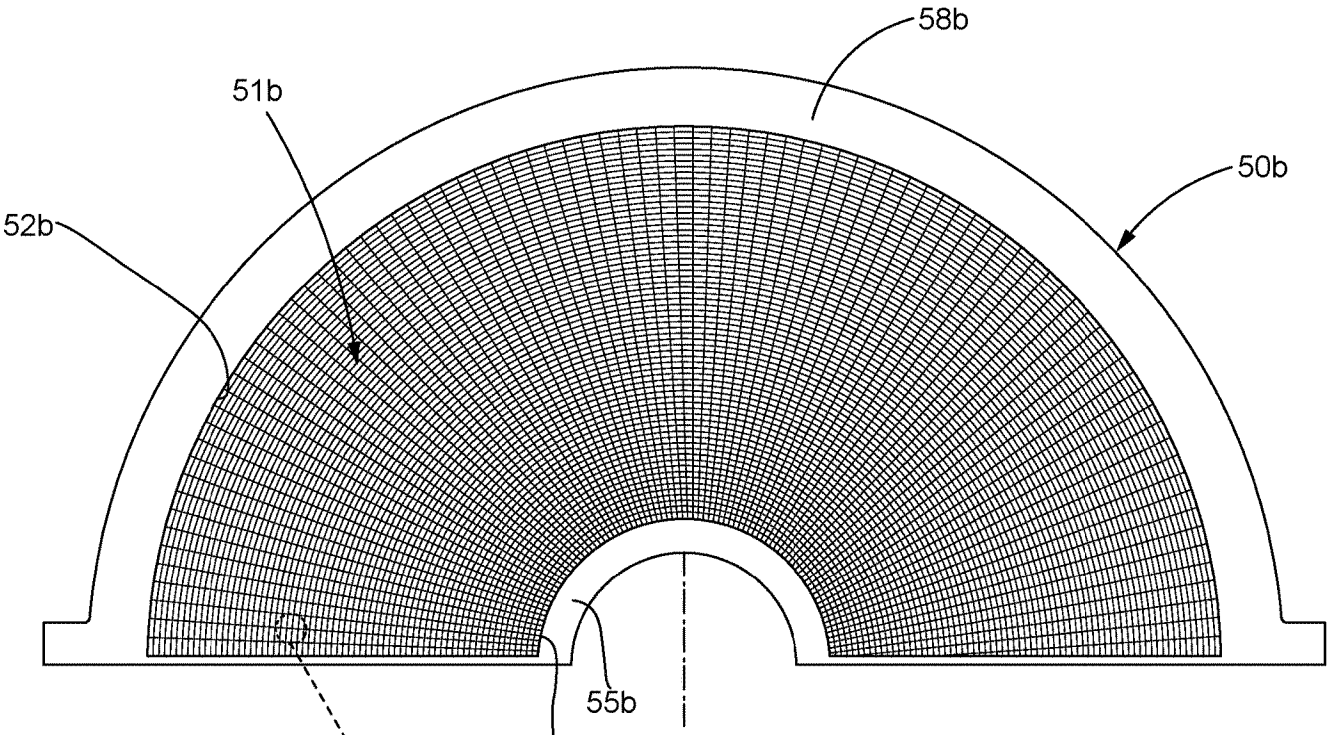
FIG. 9 is a partial top view of a disclosed frusto-conical screen for use in the conical mill apparatus illustrated in FIGS. 23-28, without distinct hole pattern sections as illustrated in FIG. 4, but with a hole pattern where the openings provide a higher open area percentage at the top of the screen and wherein the open area percentage gradually decreases towards the lower portion of the screen, which provides a lower open area percentage.
Figure 10:
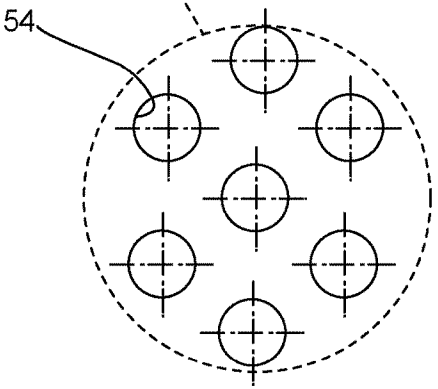
FIG. 10 is a partial and enlarged view of the hole pattern of a middle portion of the screen illustrated in FIG. 9.

Turning to FIGS. 9-10, yet another screen 50*b* is disclosed that includes the same structural features as the screens 50, 50*a*, including the flange 58*b*, bottom section 55*b*, and tapered sidewall 51*b*, which extends from a top 52*b* to a bottom 53*b*. Instead of a stepwise reduction an open area percentage from the top 52*b* to the bottom 53*b*, (or step-wise increase in the spacing distances from the top 52*b* to the bottom 53*b*) the screen 50*b* features a gradual decrease in open area percentage (or increase in spacing distances) from the top 52*b* to the bottom 53*b*. The open area near the top 52*b* of the tapered sidewall 51*b* may range from about 30% to about 50%, depending upon the material being processed, the size of the openings 54, the desired PSD, etc. Further, the open area percentage near the bottom 53*b* may range from about 15% to about 35%, depending upon a myriad of factors that will be apparent to those skilled in the art. In one non-limiting example, the open area percentage may be about 40% near the top 52*b* of the tapered sidewall 51*b* and about 25% at the bottom 53*b* of the tapered sidewall 51*b*.

Figure 11:
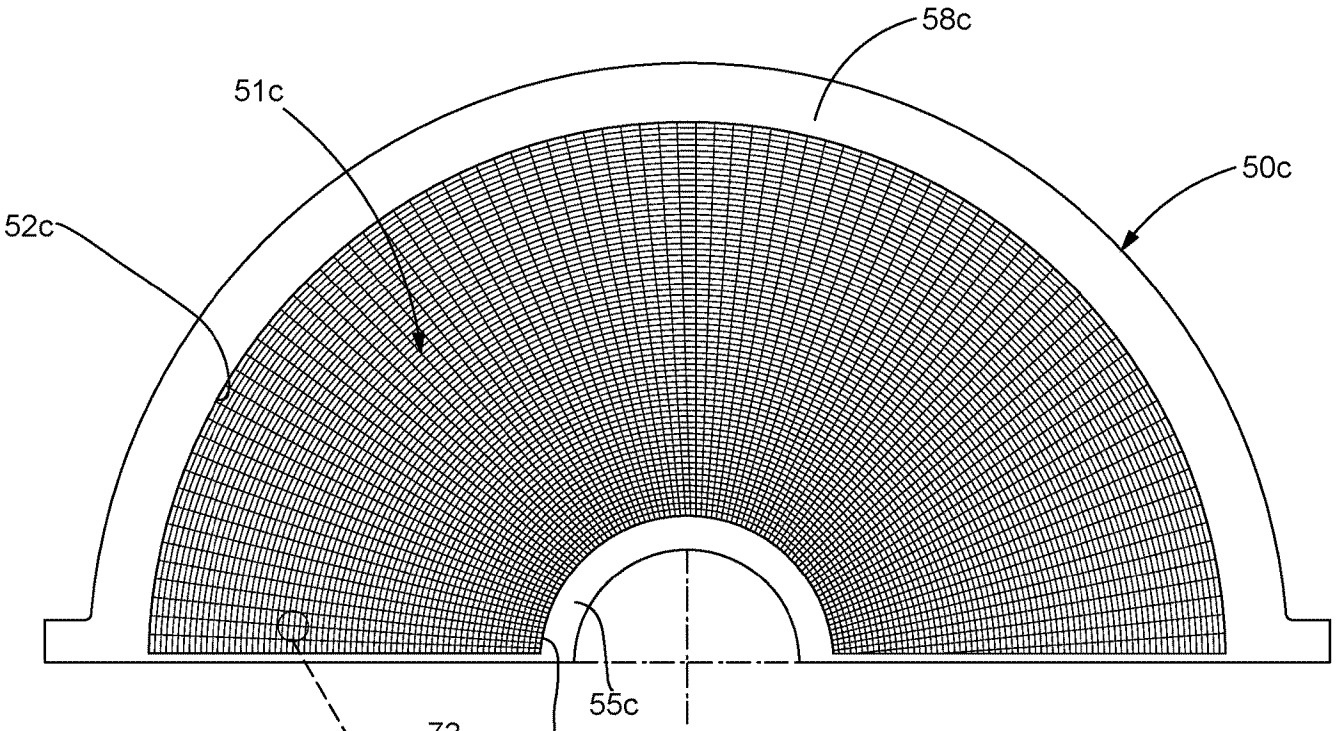
FIG. 11 is a partial top view of a disclosed frusto-conical screen for use in the conical mill apparatus shown in FIGS. 23-28, without distinct hole pattern sections as illustrated in FIG. 4, but with a hole pattern wherein the open area percentage decreases from the top to the bottom of the screen like that shown in FIG. 9, but wherein the openings are equipped with dimples or rasps.
Figure 12:
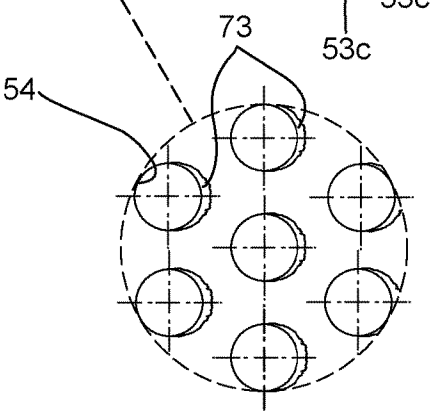
FIG. 12 is a partial and enlarged view of the hole pattern of the screen shown in FIG. 11, particularly illustrating the dimples or rasps.
Figures 13, 14:
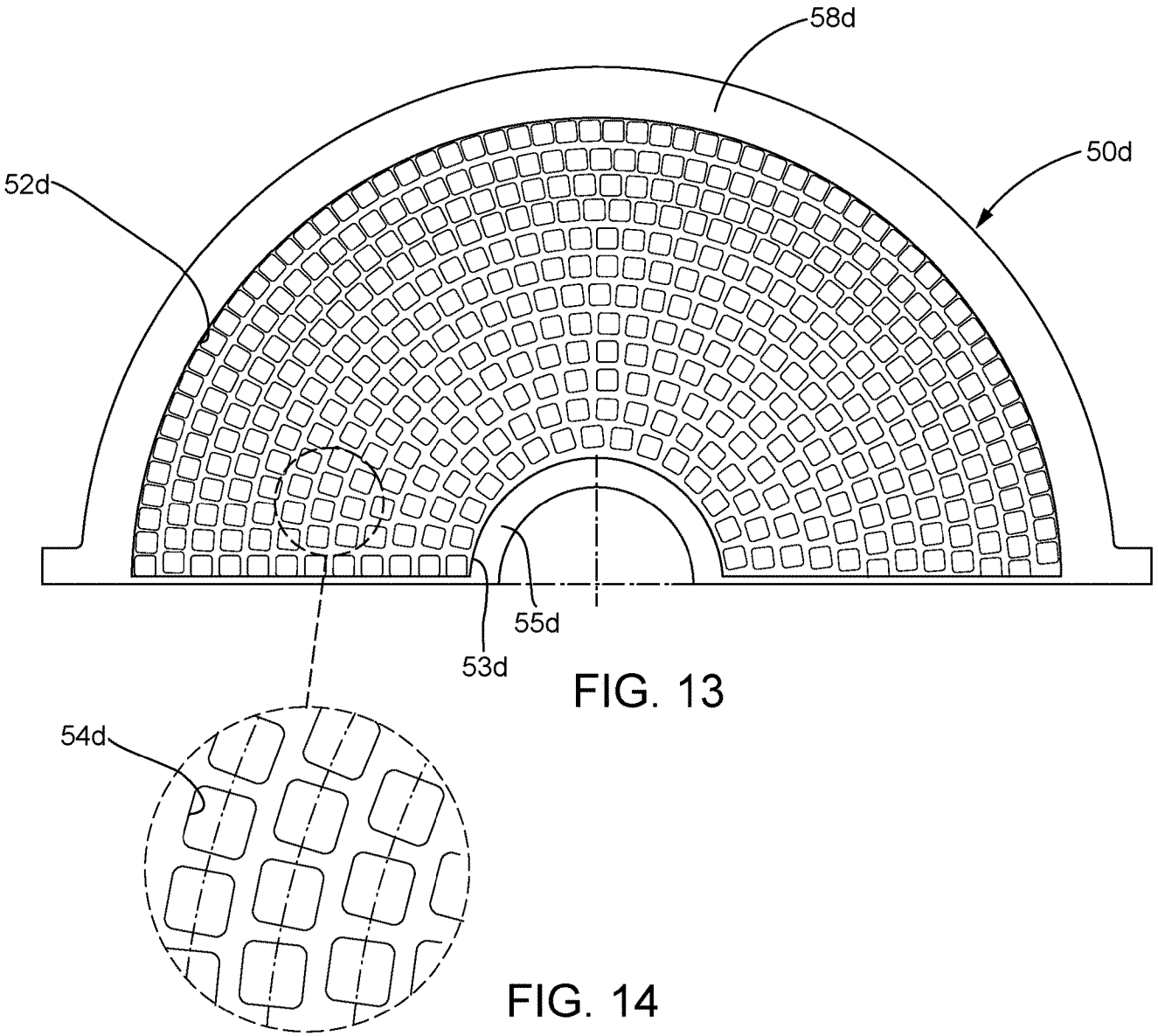
FIG. 13 is a partial top view of yet another disclosed screen for use in the conical mill apparatus shown in FIGS. 23-28, particularly illustrating a hole pattern where the openings are square or rectangular.
FIG. 14 is a partial and enlarged view of the hole pattern of the screen shown in FIG. 13.
Figure 15:
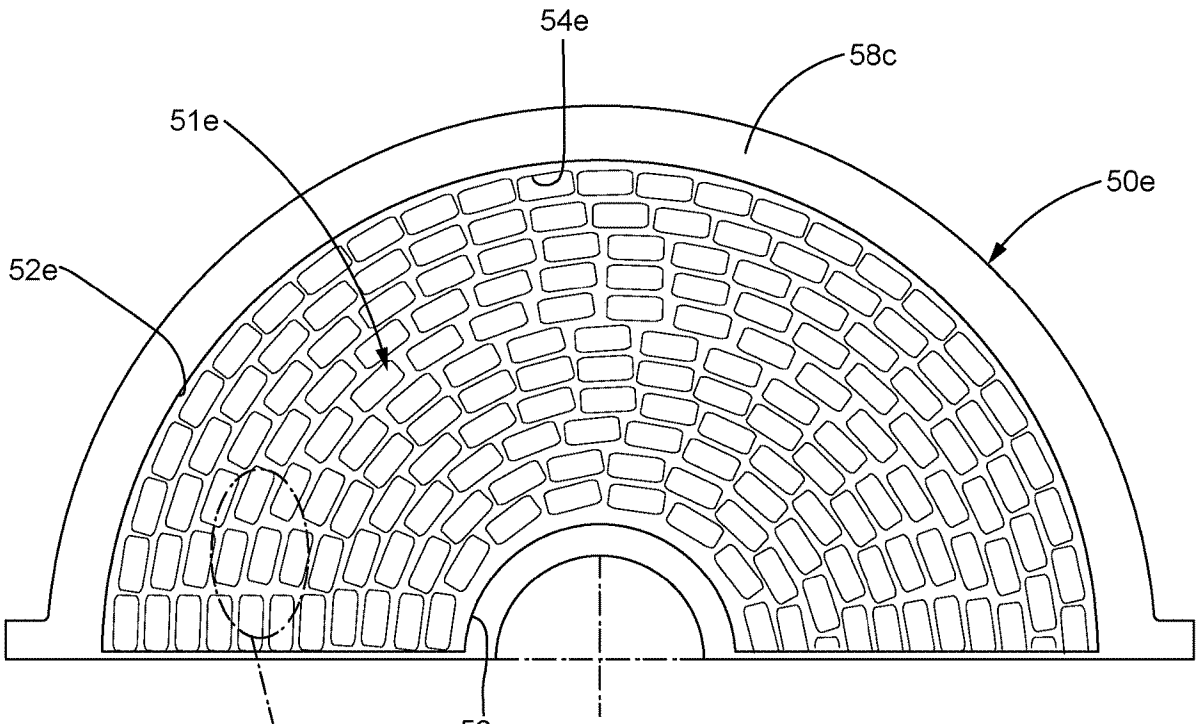
FIG. 15 is a partial top view of another disclosed frusto-conical screen for use in the conical mill apparatus shown in FIGS. 23-28, wherein the openings have a rectangular shape.
Figure 16:
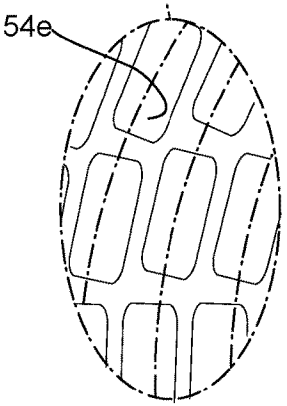
FIG. 16 is a partial and enlarged view of the hole pattern of the screen shown in FIG. 15.

Turning to FIGS. 11-12, a similar screen 50*c* is illustrated that includes the same gradual reduction in open area percentage or increase in spacing distances from the top 52*c* to the bottom 53*c* of the tapered sidewall 51*c*. However, each opening 54 includes a rasp element 73 for enhanced grinding/milling of the flowable material processed by the conical mill 62. Again, in an embodiment, the open area percentage decreases from the top 52*c* to the bottom 53*c* of the tapered sidewall 51*c* while the spacing distances increase from the top 52*c* to the bottom 53*c*.

FIGS. 13-16 illustrate two additional screens 50*d*, 50*e* wherein the openings 54*d*, 54*e* are square and rectangular respectively as opposed to the circular openings 54 illustrated in FIGS. 1, 5-8 and 10. However, the general concept remains the same; the open area percentage is highest towards the tops 52*d*, 52*e* of the tapered sidewalls 51*d*, 51*e*, and the open area percentage is the smallest at the bottoms 53*d*, 53*e* of the tapered sidewalls 51*d*, 51*e*, respectively.

Turning to FIGS. 17-22, the disclosed impeller 57 includes a recess 75 for capturing an O-ring 76 that seals the internal cavity 77 against the output shaft 78 of the gearbox 80 (see FIGS. 29-32). Cross arms 81, 82 connect the milling members 71, 72 to the central shaft 83 of the impeller 57. The shaft 83 of the impeller 57 may couple to the output shaft 78 of the gearbox 80 using a key and slot connection or other suitable means of detachable attachment. The lower end 56 of the impeller 57 fits snuggly within the bottom sections 55, 55*a*, 55*b*, 55*c*, 55*d*, 55*e* and the lower end 56 of the impeller 57 connects to the milling members 71, 72 at an outwardly extending lip 83*a* that rides on the junction of the bottoms 53, 53*a*-53*e* of the tapered sidewalls 51, 51*a*-51*e* and the bottom sections 55, 55*a*-55*e* of the screens 50, 50*a*-50*e*. See, e.g., FIGS. 3, 18 and 22.

Figure 34:
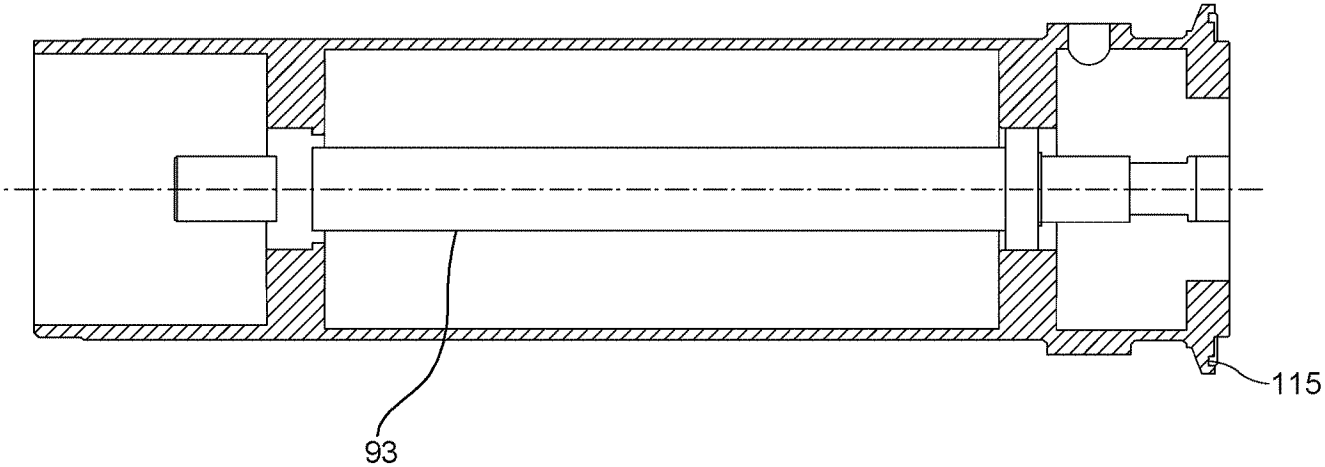
FIG. 34 is a sectional view of the spindle shown in FIG. 33.
Figure 42:
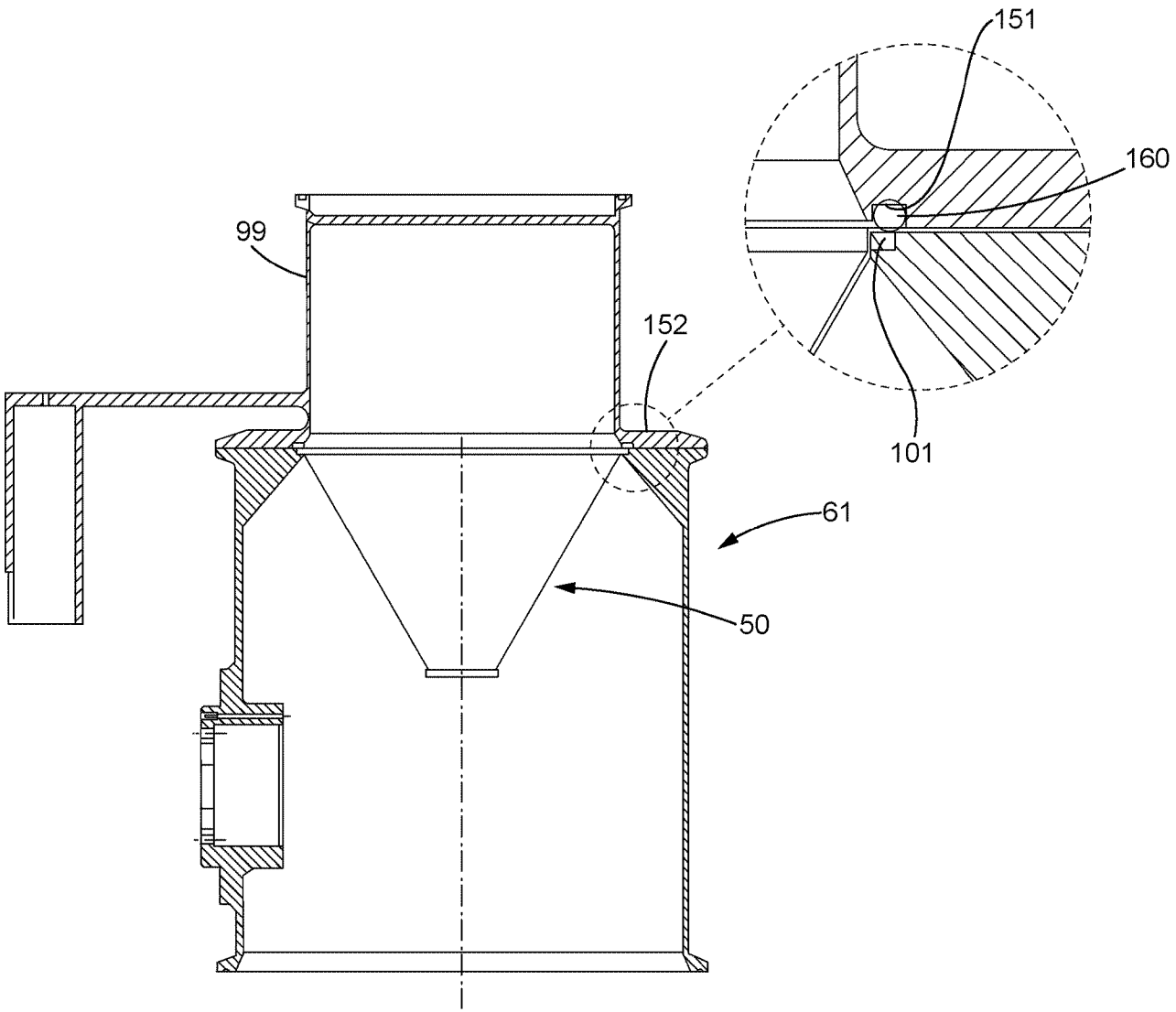
FIG. 42 is a sectional view of the housing, feed chute and screen.

In addition to the captured O-ring 76 sealing the bottom 56 of the impeller 57 against the output shaft 78, the gearbox 80 also includes a seal assembly 84 that further prevents any cross-contamination between the gearbox 80 and the milling chamber 85 provided by the housing 61 (see FIGS. 35-41). Further, the gearbox 80 may include an output gear 87 that connects to the output shaft 78 and that meshes with an input gear 88. The input gear 88 couples to an input shaft 89, which couples to a motor 91, which can be seen in FIGS. 23 and 26. In an embodiment, the input gear 88 is fabricated from non-metallic composite materials. In a further refinement of this concept, non-metallic composite materials from which the input gear 88 is fabricated may be of the type that does not require lubrication. Hence, the gearbox 80 may be a lubricant free gearbox 80 with, in addition to the seal assembly 84 and captured O-ring 76, prevent contamination of lubricant or other materials from the gearbox 80 into the milling chamber 85. The input shaft 89 passes through a gearbox housing 90 that sealably couples to a spindle housing 92 (FIG. 34) that accommodates a spindle 93 which, in turn, connects to the motor 91 illustrated in FIGS. 23 and 26. The O-ring 115 seals the spindle housing 92 to the gearbox housing 90. FIG. 24 illustrates a collection receptacle 100 that, as will be apparent to those skilled in the art, may be a bin, a container or a conveying system, such as a pneumatic conveying system.

FIGS. 23-28 illustrate one suitable conical mill 62. A supporting stand 94 may include wheels 95 and an upright support 96 for supporting a control panel 97. The stand 94 may also include an additional upright support 98 for supporting the motor 91, the spindle housing 92 and the housing 61 of the conical mill 62. A feed chute 99 (FIGS. 23-26 and 28) is disposed above the upper central opening 102 of the housing 61. The peripheral groove 101 may accommodate an O-ring 110 (FIGS. 36-37) while the peripheral groove 151 in the lower flange 152 of the housing 99 may accommodate an O-ring 160. The two O-rings 110, 160 located above and below the screen's contact points with the feed chute 99 ensures that powders during milling are only present in the internal contact surface areas and cleaning solutions cannot escape or be trapped in crevices after a cleaning cycle. The feed chute 99 detachably couples to the housing 61 via the horizontal arm 103 and vertical cylinder 104 as best seen in FIGS. 23-24. Turning to FIGS. 27 and 36, the housing 61 also includes a bottom central opening 106 that is encircled by a flange 107 having a groove or slot 108 disposed therein for accommodating an O-ring 109 that enables the bottom flange 107 (FIGS. 27 and 36) to be sealably secured to the receptacle 100 (FIG. 24). The housing 61 also includes a fitting 112 for receiving the spindle housing 92. The construction of the housing 61, feed chute 99, screens 50, 50*a*-50*e*, impeller 57, gearbox 80 and spindle housing 92, along with the aforementioned O-rings 76, 109, 110, 115, enable the conical mill 62 to be cleaned-in-place without presenting a safety hazard to the operator.

INDUSTRIAL APPLICABILITY

A conical mill 62, an improved gearbox 80 for a conical mill 62, improved frusto-conical screens 50, 50*a*, 50*b*, 50*c*, 50*d*, 50*e* and an improved impeller 57 are disclosed herein and are suitable for use in many pharmaceutical, food, chemical or cosmetics applications.

The disclosed conical mills 62, with improved screens 50, 50*a*, 50*b*, 50*c*, 50*d*, 50*e*, impeller 57 and gearbox 80, may provide any or all of the following benefits: from about 15% to greater than 50% improvement in narrowing PSDs; up to about 50% reduction in heat generation; from about 30% to greater than about 50% in increased capacity or throughput; reduced sound generation by up to 5 dBs; and the ability to clean the conical mill 62 without the need of opening the milling chamber 85 and without exposing the operator to the milled powder or dust.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A screen for a mill, the screen comprising: a tapered sidewall having a wider top and a narrower bottom, the sidewall including a plurality of openings of a uniform size, the plurality of openings disposed in a plurality of rows arranged in sets of rows from the top to the bottom, wherein each set of rows comprises one or more rows; each opening separated from adjacent openings by spacing distances, the spacing distances between each opening in a row being substantially equidistant to each other, the spacing distances at the top of the sidewall being less than the spacing distances at the bottom of the sidewall, wherein the spacing distances of adjacent openings of one set of rows is less than the spacing distances of adjacent openings of a successive set of rows, the successive set of rows being towards the bottom; wherein the sidewall further includes a total surface area interrupted by the openings, the sidewall also comprising an upper section, an upper middle section, a lower middle section, and a lower section, the openings in the upper section provide an open area percentage ranging from about 30% to about 50% of the total surface area of the sidewall in the upper section, the openings in the upper middle section provide an open area percentage ranging from about 25% to about 45% of the total surface area of the sidewall in the upper middle section, the openings in the lower middle section provide an open area percentage ranging from about 20% to about 40% of the total surface area of the sidewall in the lower middle section, the openings in the lower section provide an open area percentage ranging from about 15% to about 35% of the total surface area of the sidewall in the lower section; wherein the screen is configured to receive an impeller, the impeller configured to rotate within the screen at a rotational speed; and wherein the open area percentages of the upper section, upper middle section, lower middle section, and lower section compensate for the rotational speed of the impeller to promote an even particle size distribution of a material passing through the openings of the tapered sidewall, wherein lower rotational speeds of the impeller near the bottom of the sidewall are compensated for with a lower open area percentage, and higher rotational speeds of the impeller near the top of the sidewall are compensated for with a higher open area percentage.

2. The screen of claim 1 wherein the sidewall is frustoconically shaped.

3. The screen of claim 1 wherein the openings have a shape selected from the group consisting of round, square and rectangular.

4. The screen of claim 1 wherein the sidewall at each opening includes an inwardly extending rasp or dimple.

5. The screen of claim 1, wherein the screen further includes: an outer flange relative the top of the tapered sidewall, the outer flange configured to support the screen within a housing of the mill; and a tab relative the top of the sidewall.

6. A screen for a mill, the screen comprising: a tapered sidewall having a wider top and a narrower bottom, the sidewall including a plurality of openings of a uniform size, the plurality of openings disposed in a plurality of rows arranged insets of rows from the top to the bottom, wherein each set of rows comprises one or more rows; each opening separated from adjacent openings by spacing distances, the spacing distances between each opening in a row being substantially equidistant to each other, the spacing distances at the top of the sidewall being less than the spacing distances at the bottom of the sidewall, wherein the spacing distances of adjacent openings of one set of rows is less than the spacing distances of adjacent openings of a successive set of rows, the successive set of rows being towards the bottom; wherein the sidewall includes a total surface area interrupted by the openings that cumulatively provide an open area percentage, and wherein the open area percentage is about 40% at the top of the sidewall, the open area percentage is about 25% at the bottom of the sidewall, and the openings disposed between the top and the bottom of the sidewall provide an open area percentage ranging from less than 40% to greater than 25%; wherein the screen is configured to receive an impeller, the impeller configured to rotate within the screen at a rotational speed; and wherein the open area percentages of the top and the bottom of the sidewall compensate for the rotational speed of the impeller to promote an even particle size distribution of a material passing through the openings of the tapered sidewall, wherein lower rotational speeds of the impeller near the bottom of the sidewall are compensated for with a lower open area percentage, and higher rotational speeds of the impeller near the top of the sidewall are compensated for with a higher open area percentage.

* * * * *